US010156043B2

(12) United States Patent
Zhang et al.

(10) Patent No.: US 10,156,043 B2
(45) Date of Patent: Dec. 18, 2018

(54) REUSABLE WATER WRITING PAPER, PREPARATION METHOD THEREOF, AND INKLESS PRINTING DEVICE USED FOR SAME

(71) Applicant: Jilin University, Changchun, Jilin (CN)

(72) Inventors: Sean Xiao-An Zhang, Changchun (CN); Lan Sheng, Changchun (CN); Minjie Li, Changchun (CN)

(73) Assignee: Jilin University, Jilin (CN)

( * ) Notice: Subject to any disclaimer, the term of this patent is extended or adjusted under 35 U.S.C. 154(b) by 175 days.

(21) Appl. No.: 14/895,203

(22) PCT Filed: Sep. 3, 2014

(86) PCT No.: PCT/CN2014/085847

§ 371 (c)(1),
(2) Date: Dec. 1, 2015

(87) PCT Pub. No.: WO2015/032327

PCT Pub. Date: Mar. 12, 2015

(65) Prior Publication Data

US 2016/0168797 A1 Jun. 16, 2016

(30) Foreign Application Priority Data

Sep. 9, 2013 (CN) ..... 2013 1 0405782
Sep. 11, 2013 (CN) ..... 2013 1 0410903

(51) Int. Cl.

| | |
|---|---|
| ***D21H 19/42*** | (2006.01) |
| ***D21H 11/14*** | (2006.01) |
| ***D21H 21/30*** | (2006.01) |
| ***D21H 23/50*** | (2006.01) |
| ***D21H 25/02*** | (2006.01) |

(52) U.S. Cl.

CPC ..... *D21H 19/42* (2013.01); *D21H 5/0047* (2013.01); *D21H 11/14* (2013.01); *D21H 21/30* (2013.01); *D21H 23/50* (2013.01); *D21H 25/02* (2013.01)

(58) Field of Classification Search

CPC ..... D21H 19/42; D21H 5/0047; D21H 11/14; D21H 21/30; D21H 23/50; D21H 25/02

USPC ..... 428/537.5

See application file for complete search history.

(56) References Cited

U.S. PATENT DOCUMENTS

| | | | | |
|---|---|---|---|---|
| 7,399,319 | B2 * | 7/2008 | Plos | A61K 8/49 132/202 |
| 2007/0174977 | A1 * | 8/2007 | Plos | A61K 8/49 8/405 |

FOREIGN PATENT DOCUMENTS

| | | | |
|---|---|---|---|
| CA | 2053094 | * | 4/1992 |
| CA | 2053094 | A1 | 4/1992 |
| CN | 2628572 | Y | 7/2004 |
| CN | 1598145 | * | 3/2005 |
| CN | 1599145 | A | 3/2005 |
| CN | 102555519 | * | 7/2012 |
| CN | 102555519 | A | 7/2012 |
| CN | 102947105 | A | 2/2013 |
| CN | 103087703 | * | 5/2013 |
| CN | 103087703 | A | 5/2013 |
| CN | 203172253 | U | 9/2013 |
| CN | 103434270 | * | 12/2013 |
| CN | 103434270 | A | 12/2013 |
| CN | 103434309 | * | 12/2013 |
| CN | 103434309 | A | 12/2013 |
| CN | 104141262 | A | 11/2014 |
| EP | 2 033 792 | A2 | 3/2009 |
| EP | 2033792 | * | 3/2009 |
| FR | 2 888 747 | A | 1/2007 |
| FR | 2888747 | * | 1/2007 |

OTHER PUBLICATIONS

International Search Report, dated Nov. 28, 2014, for International Application No. PCT/CN2014/085847, 4 pages.
Chinese Office Action dated Sep. 29, 2015, for Chinese Application 201310405782.2, 2 pages.
Chinese Office Action dated May 20, 2015, for Chinese Application 201310410903.2, 1 page.
Chinese Office Action dated Feb. 12, 2015, for Chinese Application 201310405782.2, 3 pages.
Chinese Office Action dated Oct. 21, 2014, for Chinese Application 201310410903.2, 5 pages.
Sheng et al., "Hydrochromic molecular switches for water-jet rewritable paper," *Nature Communications* 5(3044):1-8, Jan. 2014.
Extended European Search Report, dated Mar. 10, 2017, for European Application No. 14842864.2-1308, 6 pages.

* cited by examiner

*Primary Examiner* — Leszek B Kiliman
(74) *Attorney, Agent, or Firm* — Seed IP Law Group LLP

(57) ABSTRACT

The present invention relates to a reusable water writing paper, as well as to its production process and an inkless printing device thereof. The reusable water writing paper is consisted of a substrate as structure-support material, a color-displaying component supported on the substrate, and an optional performance-enhancing additive, wherein the color-displaying component is an oxazoline-based hydrochromic dye, which can change color obviously to display characters and/or patterns after contacting with water, and revert to the initial color to disappear the displayed characters and/or patterns after the water is removed, thereby the water writing paper is reusable. The paper is not only suitable for the exercise of writing or drawing with a brush pen, but also can be used for daily writing with a pen. Furthermore, inkless printing also can be achieved by spraying water.

11 Claims, No Drawings

REUSABLE WATER WRITING PAPER, PREPARATION METHOD THEREOF, AND INKLESS PRINTING DEVICE USED FOR SAME

TECHNICAL FIELD

The present invention relates to a novel reusable water writing paper that displays color when contacting with water, as well as a production process thereof, an inkless printing device for the above-mentioned reusable water writing paper.

BACKGROUND ART

It is a serious waste to use disposable paper for writing or printing, and from the viewpoint of the protection of environment and the reuse of resources, it is particularly important for the cyclic utilization of papers. At present, there is much reusable water writing paper on market that displays color when contacting with water. However, such existing water writing paper is either consisted of a paper substrate, a carbon black layer and a white-sprinkled layer, or is directly consisted of a dark base paper and a white-sprinkled layer. For example, CN2628572Y discloses a reusable water writing paper. However, such water writing display is achieved on a physical change that the white-sprinkled layer becomes transparent upon contacting with water, and make the underneath carbon black layer or dark base paper visible. Most of the color of characters displayed by the water writing papers produced with this process is black, without a high contrast and resolution, and the applied field is limited to writing exercise and drawing. There is a great potential market to develop a kind of water writing paper that has various color choices, satisfies the requirements for both writing and printing at the same time, and can be reusable.

In addition, since an inkjet printer has several advantages, for example, the machine itself is cheaper than a laser printer; also it has lower amount of irradiation than a laser machine, zero ozone production, and the prints is brightness, or the like, it is always very favorite. However, the ink of an inkjet printer is easily rebarbative, on one hand, frequent replacement of the ink cartridge causes the increase in the subsequent costs; on the other hand, the consumer may also suffer to stains by the ink without a careful caution. From the viewpoint of environment protection, the frequent replacement of consumptive materials results in large amount of industrial wastes, and inappropriate treatment may further result in the contamination of water and soils. Furthermore, when one wants to print something, the ink of an inkjet printer may also block the nozzle due to the non-use for a long time. In order to solve the problems caused by the frequent replacement of ink cartridges or being stained by the ink, at present, some printer manufacturers use the way to connect a continuous ink supply system (CISS) to the printer. However, the problems such as the subsequent costs for re-injecting ink and the nozzle clogging caused by not being used frequently are not solved yet. If the subsequent costs for injecting ink can be decreased or even eliminated, the users of an inkjet printer will be greatly increased.

In order to satisfy the consumer's requirements for daily printing and for business printing, at the same time in view of the eternal theme of green environment protection, the inkless printing technique is proposed and attracts the attention at home and abroad. The key for the inkless printing technique is the paper adopted. Inkless does not mean that there is no ink to be used, but the ink is transferred onto the paper. Based on this kind of special ink-containing paper, in combination with a printing device capable of stimulating the ink-containing paper to change colors, inkless printing can be achieved.

Inkless printing device enables the realization of inkless printing. On one hand, it solves the problems such as the solid waste pollution caused by the frequent replacement of ink cartridges and the nozzle clogging. On the other hand, if the ink-containing color-changeable substrate can be reused, the dissipatation of paper may also be reduced. Because environment protection and energy saving are advocated more and more in this society, it is believed that, inkless printing which is cheap, performance stable, energy saving and environment protecting will be occurred in office or home gradually with the continuous development of the printing techniques and reusable erasing/writing materials. The application of inkless printing devices will also be more common.

SUMMARY OF THE INVENTION

The object of the present invention is to provide a novel reusable water writing paper, a production process and an inkless printing device thereof.

To this end, in one aspect, the present invention provides a reusable water writing paper, which is consisted of a substrate as a structure-support material, a color-displaying component supported on the substrate, and an optional performance-enhancing additive, wherein the color-displaying component is an oxazoline-based hydrochromic dye (also known as a water-induced color-changeable dye), which can change color obviously to display characters and/or patterns upon contacting with water, and revert to its initial color to erase the displayed characters and/or patterns after the water is removed, and thus the water writing paper is reusable.

In a preferred embodiment, the performance-enhancing additive is one or more selected from polyethylene glycol, polyethylene oxide, polyvinyl alcohol, polyvinyl pyrrolidone, sodium chloride, ammonium chloride, thionyl chloride, polyacrylamide, cyclodextrin, molecular sieve, silica gel and acidified bentonite.

In a preferred embodiment, the color-displaying component is one or more selected from:

(E)-4-(2-(9,9-dimethyl-2,3,9,9a-tetrahydroxazoline[3,2-a] indole-9a-)vinyl)-N,N-dimethylaniline (also known as (E)10-[2-(4-dimethylaminophenyl)ethylene]-9,9-trimethyl-indolino[2,1-b]oxazoline), (E)-4-(2-(9,9-dimethyl-7-nitro-2,3,9,9a-tetrahydroxazoline [3,2-a]indole-9a-)vinyl)-N,N-dimethylaniline (also known as (E)10-[2-(4-dimethylaminophenyl)ethylene]-9,9-trimethyl-7-nitro-indolino[2,1-b]oxazoline, and (E)-9,9-dimethyl-9a-(4-methoxystyryl)-2,3,9,9a-tetrahydroxazoline[3,2-a]indole (also known as (E)10-[2-(4-methoxylphenyl) ethylene]-9,9-trimethyl-indolino[2,1-b] oxazoline).

In a preferred embodiment, the material of the substrate is a fiber-based, a rubber-based, a metal-based, a glass-based, a asbestos-based or a polymer-based material, preferably printing paper or filter paper.

In a preferred embodiment, the reusable water writing paper displays different colors, depending on the different color-displaying components used.

In another aspect, the present invention provides a process for producing the above-mentioned reusable water writing paper, which comprises dissolving a color-displaying component in an alcohol solvent to produce an alcohol solution of the color-displaying component;

dissolving a performance-enhancing additive, when present, in water to produce an aqueous solution of the performance-enhancing additive;

mixing the alcohol solution of the color-displaying component with the aqueous solution of the performance-enhancing additive, and then coating the mixture onto the substrate; and heating the coated substrate, thereby a reusable water writing paper is produced.

In another aspect, the present invention provides an inkless printing device useful for the above-mentioned reusable water writing paper, which comprises a spraying unit and an ink cartridge for containing water, wherein the spraying unit is used for spraying or coating water from the ink cartridge to the reusable water writing paper, so as to display characters and/or patterns on the reusable water writing paper.

In a preferred embodiment, the inkless printing device further comprises a heating or drying device for quick-erasing the characters and/or patterns displayed.

In a preferred embodiment, the inkless printing device further comprises a paper feeding mechanism, a printing carriage mechanism, a control circuit, and an inputting device for inputting characters and/or patterns.

In a preferred embodiment, the inkless printing device is controlled manually, or controlled automatically or semi-automatically.

The water writing paper according to the present invention can be written and display colors with only clear water, and after the water is volatilized under atmospheric conditions or the water is volatilized rapidly by heating, color disappearance can be achieved. Further, such procedure can be cycled for many times, so that reuse is realized. Since the color-displaying process relies on the reversible change in the molecular structure of the dye with the stimulation of water, it responses sensitive to water, has a high contrast before and after the color-displaying, and can achieve the displaying of different colors by changing the substituents of the hydrochromic dye molecule. When writing on the paper, the characters are clear, being difficult to be diffused, with a smooth surface, and the paper is reusable. The paper is not only suitable for exercise of writing with a brush pen or drawing, but also can be used in daily writing with pens. Furthermore, inkless printing also can be achieved by spraying water. Due to the special response to water, this kind of water writing paper also can be applied to the fields such as moisture-detecting card, anti-counterfeiting, and the like.

DETAILED DESCRIPTION OF EMBODIMENTS

The novel reusable water writing paper according to the present invention is consisted of a substrate as a structure-support material, a color-displaying component supported on the substrate, and an optional performance-enhancing additive, wherein the color-displaying component can change color obviously to display characters and/or patterns upon contacting with water, and revert to its initial color to erase the displayed characters and/or patterns after the water is removed, thereby the water writing paper is reusable.

In particular, the color-displaying component described herein refers to a hydrochromic dye of which the molecular structure can change upon contacting with water accompanying with obvious color change, and the molecular structure and color can revert to its initial states after the water is removed. Depending on the different color-displaying components used, water writing papers displaying different colors can be obtained.

The substrate described herein is a structure-support material, which is used for supporting the color-displaying component and the optional performance-enhancing additive. The substrate may be a biomass material and derivates thereof, such as fibers or nature rubbers, and may also be an artificial material, such as metals, glasses, asbestos, polymers, inorganic/organic hybrid materials, or the like. The performance-enhancing additive is an organic small molecule, an organic polymer, an inorganic salt or an inorganic/organic complex material having one or more functions of color retaining, binding, moisture-retaining, wetting-enhancing, bleeding-preventing, moisture-proof, sunscreen, leakage-proof, and the like. According to the properties of the substrate, the performance-enhancing additive may also be absent.

Herein, the color retaining additive has an active group for passivating the surface of the paper substrate and preventing the paper substrate to interact with the hydrochromic dye. The color-protecting additive mainly refers to an organic compound, an organometallic compound or a polymer containing one or more hetero atoms such as oxygen, sulfur, nitrogen, phosphor, or the like, for example, polyethylene glycol, polyethylene oxide or the like.

The binding additive is used for improving the bonding degree between the substrate and the color-displaying layer, and generally is a kind of water-soluble or water-swellable polymeric materials having a binding effect, such as polyvinyl alcohol, polyethylene glycol, polyethylene oxide, polyvinyl pyrrolidone, or the like.

The moisture-retaining additive can retain moisture in the paper for a long time, is used to adjust the retention time of characters, and generally refers to a kind of organic or inorganic materials that can retain water for long time, and salts thereof, such as inorganic salts (sodium chloride, ammonium chloride, etc.), polyvinyl alcohol, thionyl chloride, peptide-based compounds and hydrogels (polyacrylamide, etc.), and the like. According to different requirements, different moisture-retaining agents may be used to achieve different retention time of characters.

The wetting-enhancing additive is used to facilitate the penetration of water and adjust the color-displaying speed. The wetting-enhancing additive generally is a kind of organic additives or inorganic additives having moisture absorption and capable of facilitating the penetration of water, such as surfactants, inorganic salts, or the like.

The bleeding-preventing additive is used for prevention the transverse diffusion of water. The bleeding-preventing additive generally used includes starch and derivates thereof or ingredients isolated from starch, cyclodextrin, molecular sieve, silica gel, acidified bentonite, or the like.

The moisture-proof additive is used as the overcoating layer to prevent the damage of the hydrochromic dye from water vapor or the like in the environment. The sunscreen additive is used to prevent the hydrochromic dye from the damage of UV or the like in the environment. The leakage-proof additive is used to prevent the safety problems caused by the leakage and direct contact of the dye or the like. Among these additives, the additive generally used is a kind of polymeric materials having hydrophilicity or water-swellability, such as polyethylene glycol, polyethylene oxide, or the like.

Additionally, according to the requirements, the above-mentioned performance-enhancing additives may be a single substance having multi-functions, or a complex of multi-component substances having different functions respectively.

The inkless printing device for the above-mentioned reusable water writing paper utilizes the reusable water writing paper mentioned above as a color-displaying substrate. The inkless printing device comprises a spraying unit and an ink cartridge for containing water, wherein the spraying unit is used to spray or coat the water (i.e. a color developing agent) in the ink cartridge onto the color-displaying substrate, thereby display characters and/or patterns on the color-displaying substrate. This type of device display the desired patterns or characters by spraying or coating the color developing agent so that it interacts physically or chemically with the color-displaying substrate, thereby inkless printing is realized.

Herein, the inkless printing device may be controlled manually, or controlled automatically or semi-automatically. The expression "controlled automatically or semi-automatically" means that the nozzle for spraying the color-developing agent is driven mechanically, and if other relative components, such as paper feeding mechanism, printing carriage mechanism, or the like, are controlled mechanically, it is controlled automatically. If, among them, one or more relative components are controlled manually, it is controlled semi-automatically. An automatically or semi-automatically controlled device needs to comprise a structural support and a spraying unit, wherein the spraying unit may move in two-dimensional directions, or may move in three-dimensional directions. The main control circuit system in the relative structures of the device may comprise a fixed support frame structure, but also may comprise no such a structure.

Herein, the direction for spraying the color-developing agent may be downward, upward, or sideward.

The spraying principle of the automatically or semi-automatically controlled inkless printing device may be continuous jetting based on a piezoelectric driving device, but also may be on demand spraying based on hot foaming or micropiezoelectric principle.

The coating may be achieved by manner of brush coating or imprinting, or the like. It may be planar knife coating, or may be coating achieved via three-dimensional rotation of a roller, and also may be coating achieved in a manner of imprinting. It may be controlled manually, or may be controlled automatically or semi-automatically. Additionally, the coating also may be achieved by printing techniques such as relief printing, intaglio printing, planographic printing, screen printing, or the like.

The inkless printing device can also comprise additional devices such as a heating device or a blowing device for quickly erasing the patterns or characters displayed by the color-developing agent.

In addition to the features above-mentioned, the relative control systems, paper feeding structures and support structures of the existing commercially available printers can be used for reference.

The present invention provides a novel water writing paper using a hydrochromic dye as the color-displaying component. It can be produced merely by chemically bonding or physically doping the color-displaying component into the substrate. The following description is only some illustrative examples provided for the readers at normal level to understand and practice the scientific principle and features of the present patent application, but it is not intended to limit the invention thereto. Any application manner based on the scientific principle and features provided by the present specification falls into the protection scope of the present patent.

In order to exemplify the present invention more specifically, a further detailed description is set forth below. For instance, the water writing paper of the present invention is obtained by using filter paper as the substrate, using polyethylene glycol or the like as the performance-enhancing additive, and using an oxazoline-based hydrochromic dye as the color-displaying component, and physically doping the color-displaying component and the performance-enhancing agent into the substrate. Characters or patterns can be displayed clearly when they are written with a pen or a brush pen carrying clear water or by spraying water with a mask. When the paper is left for volatilizing naturally, or placed on a heating platform at a certain temperature for a certain time, or blown by hot wind with an electric drier, the written characters or patterns disappear, and it can be cycled for many times. Depending on the different substituents on the molecule of the oxazoline-based hydrochromic dye, water writing paper displaying characters or patterns with different colors can be obtained. Such water writing paper can be used in an inkless printing device.

The following examples are only used for the purpose of exemplifying the present invention, but are not intended to limit the scope of the present invention.

Preparation Example 1

The color-displaying component used was (E)-4-(2-(9,9-dimethyl-2,3,9,9a-tetrahydroxazoline[3,2-a]indole-9a-)vinyl)-N, N-dimethylaniline dye, polyethylene glycol was used as a color-retaining-retaining agent and a binder in the performance-enhancing agent, and polyethylene oxide, having the functions of moisture-proof, sunscreen, leakage-proof and the like concurrently, was used as the performance-enhancing agent. The dye molecule was dissolved in ethanol, polyethylene glycol was dissolved in water, and the ethanol solution of the dye molecule and the aqueous solution of polyethylene glycol were mixed, then coated onto a paper substrate, and a water writing paper was obtained via thermal treatment.

Upon writing with a pen or brush pen carrying clear water, the characters written on this water writing paper displayed a pink color. In a natural environment, these characters disappeared after 30 minutes. The paper can be reused for many times.

Preparation Example 2

The color-displaying component used was (E)-4-(2-(9,9-dimethyl-2,3,9,9a-tetrahydroxazoline[3,2-a]indole-9a-)vinyl)-N,N-dimethylaniline dye, polyethylene glycol was used as a color-retaining agent and a binder in the performance-enhancing agent, and polyethylene oxide, having the functions of moisture-proof, sunscreen, leakage-proof and the like concurrently, was used as the performance-enhancing agent. The dye molecule was dissolved in ethanol, polyethylene glycol was dissolved in water, and the ethanol solution of the dye molecule and the aqueous solution of polyethylene glycol were mixed in a volume ratio of 2:3, then coated onto a paper substrate, and a water writing paper was obtained via thermal treatment.

Upon writing with a pen or brush pen carrying clear water, the characters written on this water writing paper displayed a pink color. When heated on a heating platform at 70° C., the characters disappeared after 0.5 minute. The paper can be reused for many times.

Preparation Example 3

The color-displaying component used was (E)-4-(2-(9,9-dimethyl-7-nitro-2,3,9,9a-tetrahydroxazoline[3,2-a]indole-9a-)vinyl)-N,N-dimethylaniline dye, polyethylene glycol was used as a color-retaining agent and a binder in the performance-enhancing agent, and polyethylene oxide, having the functions of moisture-proof, sunscreen, leakage-proof and the like concurrently, was used as the performance-enhancing agent. The dye molecule was dissolved in ethanol, polyethylene glycol was dissolved in water, and the ethanol solution of the dye molecule and the aqueous solution of polyethylene glycol were mixed in a volume ratio of 2:3, then coated onto a paper substrate, and a water writing paper was obtained via thermal treatment, Upon writing with a pen or brush pen carrying clear water, the characters written on this water writing paper displayed a blue color. In a natural environment, the characters disappeared after 30 minutes. The paper can be reused for many times.

Preparation Example 4

The color-displaying component used was (E)-9,9-dimethyl-9a-(4-methoxystyryl)-2,3,9,9a-tetrahydroxazoline[3,2-a]indole, polyethylene glycol was used as a color-retaining agent and a binder in the performance-enhancing agent, and polyethylene oxide, having the functions of moisture-proof, sunscreen, leakage-proof and the like concurrently was used as the performance-enhancing agent. The dye molecule was dissolved in ethanol, polyethylene glycol was dissolved in water, and the ethanol solution of the dye molecule and the aqueous solution of polyethylene glycol were mixed in a volume ratio of 2:1, then coated onto a paper substrate, and a water writing paper was obtained via thermal treatment.

Upon writing with a pen or brush pen carrying clear water, the characters written on this water writing paper displayed a yellow color. In a natural environment, the characters disappeared after 30 minutes. The paper can be reused for many times.

Preparation Example 5

The color-displaying component used was (E)-4-(2-(9,9-dimethyl-7-nitro-2,3,9,9a-tetrahydroxazoline[3,2-a]indole-9a-)vinyl)-N,N-dimethylaniline, polyethylene glycol was used as a color-retaining agent and a binder in the performance-enhancing agent, polyethylene oxide, having the functions of moisture-proof, sunscreen, leakage-proof and the like concurrently, was used as the performance-enhancing agent, and sodium chloride was used as the moisture-retaining agent. The dye molecule was dissolved in ethanol, polyethylene glycol was dissolved in water, and the ethanol solution of the dye molecule and the aqueous solution of polyethylene glycol together with the aqueous solution of sodium chloride were mixed, then coated onto a paper substrate, and a water writing paper was obtained via thermal treatment.

Upon writing with a pen or brush pen carrying clear water, the characters written on this water writing paper displayed a blue color. In a natural environment, the characters disappeared after approximate 4 hours. The paper can be reused for many times.

Preparation Example 6

The color-displaying component used was (E)-4-(2-(9,9-dimethyl-7-nitro-2,3,9,9a-tetrahydroxazoline[3,2-a]indole-9a-)vinyl)-N,N-dimethylaniline, polyethylene glycol was used as a color-retaining agent and a binder in the performance-enhancing agent, polyethylene oxide, having the functions of moisture-proof, sunlight-proof, leakage-proof and the like concurrently, was used as the performance-enhancing agent, and sodium nitrate was used as the moisture-retaining agent. The dye molecule was dissolved in ethanol, polyethylene glycol was dissolved in water, and the ethanol solution of the dye molecule and the aqueous solution of polyethylene glycol together with the aqueous solution of sodium nitrate were mixed, then coated onto a paper substrate, and a water writing paper was obtained via thermal treatment.

Upon writing with a pen or brush pen carrying clear water, the characters written on this water writing paper displayed a blue color. In a natural environment, the characters disappeared after approximate 30 hours. The paper can be reused for many times.

The water writing paper obtained from the above-mentioned Preparation Examples 1-6 can also be used for inkless printing. The examples of the inkless printing device used in the present invention can be exemplified as follows, but not be limited thereto.

Application Example 1

Pure water was charged as a color-developing agent in a sprayer (i.e. a spraying device). A hollow-out stencil for the desired characters or patterns and a recovery device for excess waste liquid were attached to the nozzle of the sprayer, and thus a simple manually-controlled inkless printing device was prepared. When water was sprayed onto a water writing paper based on a hydrochromic dye (i.e. a water writing paper obtained from any one of the above-mentioned Preparation Examples 1-6), characters or patterns same as the stencil could be displayed, thereby no-ink printing was achieved by spraying water.

Application Example 2

Pure water was charged as a color-developing agent in a sprayer, and thus a simple manually-controlled inkless printing device was prepared. Desired characters or patterns could be displayed by controlling the different locations sprayed by the sprayer on the water writing paper based on a hydrochromic dye (i.e. a water writing paper obtained from any one of the above-mentioned. Preparation Examples 1-6), thereby no-ink printing was achieved by spraying water.

Application Example 3

A paper feeding mechanism, a printing carriage mechanism and main control circuit were mounted in a no-ink printing device. Pure water was charged as a color-developing agent in the corresponding empty ink cartridge, and thus an automatically controlled inkless printing device based on the thermal foaming principle and spraying the color-developing agent downwards or sidewards was prepared. When a water writing paper based on a hydrochromic dye (i.e. a water writing paper obtained from any one of the above-mentioned. Preparation Examples 1-6) was used as the color-displaying substrate, and the characters or patterns to be printed were input into a computer, the corresponding printed characters or patterns could be obtained, thereby inkless printing was achieved by spraying water.

Application Example 4

A printing carriage mechanism and a main control circuit of a Hewlett-Packard printer was used, and pure water was charged as a color-developing agent in the corresponding empty ink cartridge, and thus a semiautomatically controlled inkless printing device based on the thermal foaming principle and spraying color-developing agent downwards was prepared. When a water writing paper based on a hydrochromic dye (i.e. a water writing paper obtained from any one of the above-mentioned Preparation Examples 1-6) was moved manually, and the characters or patterns to be printed were input into a computer, the corresponding printed characters or patterns could be obtained, thereby no-ink printing was achieved by spraying water.

Application Example 5

A paper feeding mechanism, a printing carriage mechanism, and a main control circuit were mounted in a inkless printing device. Pure water was charged as a color-developing agent in the corresponding empty ink cartridge, an thus an automatically controlled inkless printing device based on micropiezoelectricity principle and spraying color-developing agent downwards was prepared. When a water writing paper based on a hydrochromic dye (i.e. a water writing paper obtained from any one of the above-mentioned Preparation Examples 1-6) was used as the color-displaying substrate, and the characters or patterns to be printed were input into a computer, the corresponding printed characters or patterns could be obtained, thereby inkless printing was achieved by spraying water.

The invention claimed is:

1. A reusable water writing paper comprising: a substrate as a structure-support material, a color-displaying component supported on the substrate, and an optional performance-enhancing additive, wherein the color-displaying component is an oxazoline-based hydrochromic dye, which changes color visibly to display characters and/or patterns upon contacting with water, and revert to its initial color to erase the displayed characters and/or patterns after the water is removed, thus rendering the water writing paper reusable.

2. The reusable water writing paper according to claim 1, wherein the performance-enhancing additive is polyethylene glycol, polyethylene oxide, polyvinyl alcohol, polyvinyl pyrrolidone, sodium chloride, ammonium chloride, thionyl chloride, polyacrylamide, cyclodextrin, molecular sieve, silica gel, acidified bentonite or a combination thereof.

3. The reusable water writing paper according to claim 1, wherein the color-displaying component is:

(E)-4-(2-(9,9-dimethyl-2,3,9,9a-tetrahydroxazoline[3,2-a]indole-9a-)vinyl)-N,N-dimethylaniline, (E)-4-(2-(9,9-dimethyl-7-nitro-2,3,9,9a-tetrahydroxazoline[3,2-a]indole-9a-)vinyl)-N,N-dimethylaniline, or (E)-9,9-dimethyl-9a-(4-methoxystyryl)-2,3,9,9a-tetrahydroxazoline[3,2-a]indole.

4. The reusable water writing paper according to claim 1, wherein the material of the substrate is fiber-based, rubber-based, metal-based, glass-based, asbestos-based or polymer-based material.

5. The reusable water writing paper according to claim 1, wherein the reusable water writing paper displays different colors, depending on the different color-displaying components used.

6. A process for producing the reusable water writing paper according to claim 1, which comprises:

dissolving a color-displaying component in an alcohol solvent to obtain an alcohol solution of the color-displaying component;

dissolving, if present, a performance-enhancing additive in water to obtain an aqueous solution of the performance-enhancing additive;

mixing the alcohol solution of the color-displaying component and the aqueous solution of the performance-enhancing additive, and then coating the mixture onto the substrate; and heating the coated substrate, thereby a reusable water writing paper is produced.

7. An inkless printing device for a reusable water writing paper according to claim 1, said inkless printing device comprising a spraying unit and an ink cartridge for storing water, wherein the spraying unit is for spraying or coating water in the ink cartridge onto the reusable water writing paper, thereby displaying characters and/or patterns on the reusable water writing paper.

8. The inkless printing device according to claim 7, wherein the inkless printing device further comprises a heating or drying device for erasing the displayed characters and/or patterns quickly.

9. The inkless printing device according to claim 7, wherein the inkless printing device further comprises a paper feeding mechanism, a printing carriage mechanism, a control circuit, and a inputting device for inputting characters and/or patterns.

10. The inkless printing device according to claim 7, wherein the inkless printing device is controlled manually, or controlled automatically or semi-automatically.

11. The reusable water writing paper according to claim 4, wherein the material of the substrate is a printing paper or filter paper.

* * * * *